US007398816B2

(12) United States Patent
Sala

(10) Patent No.: US 7,398,816 B2
(45) Date of Patent: Jul. 15, 2008

(54) WINDOW SHADE

(75) Inventor: Andre Sala, Albany, CA (US)

(73) Assignee: Star H.K. Electronic Limited, Kowloon (HK)

( * ) Notice: Subject to any disclaimer, the term of this patent is extended or adjusted under 35 U.S.C. 154(b) by 561 days.

(21) Appl. No.: 11/051,335

(22) Filed: Feb. 7, 2005

(65) Prior Publication Data

US 2005/0178511 A1 Aug. 18, 2005

(30) Foreign Application Priority Data

Feb. 5, 2004 (GB) ..... 0402480.8

(51) Int. Cl.
*E06B 9/00* (2006.01)

(52) U.S. Cl. ..... 160/368.1; 160/127; 160/10

(58) Field of Classification Search ..... 160/370.21, 160/368.1, 10, 127; 296/97.6, 97.1; 446/227, 446/477, 175, 485, 397, 404
See application file for complete search history.

(56) References Cited

U.S. PATENT DOCUMENTS

| | | | | |
|---|---|---|---|---|
| 5,247,391 | A * | 9/1993 | Gormley | 359/601 |
| 6,433,498 | B1 * | 8/2002 | Domel et al. | 318/280 |
| 6,794,011 | B2 * | 9/2004 | Allard | 428/99 |
| 6,997,501 | B2 * | 2/2006 | Conforti | 296/97.5 |
| 7,037,168 | B2 * | 5/2006 | Wu | 446/227 |
| 2003/0136528 | A1 * | 7/2003 | Dunn et al. | 160/370.22 |

FOREIGN PATENT DOCUMENTS

JP 401192989 * 8/1989

* cited by examiner

*Primary Examiner*—Blair M. Johnson
(74) *Attorney, Agent, or Firm*—Buchanan Ingersoll & Rooney PC

(57) ABSTRACT

A window shade (16) including a sheet of translucent shade material (1) to provide shade from light, a panel (3) with an electrically powered motor, light-emitting diodes (LED's) (6) and a speaker (11) for producing motion, light and/or sound, and suction cups (4) for detachably attaching the sheet of shade material (1) to a window.

14 Claims, 5 Drawing Sheets

WINDOW SHADE

This invention relates to a window shade for providing shade from sunshine and providing entertainment, e.g. for young children.

BACKGROUND OF THE INVENTION

Window shades have been in existence for a long time, in particular for detachable attachment to windows of cars or of premises, for providing shade from sunlight. Some such devices are provided with graphics and/or other decorations to increase the aesthetic appeal of the shade.

When young children, e.g. toddlers or babies, are carried in a car or placed next to a window in a flat, a driver or parent may find it desirable to attract the attention of the young children. However, such means for attracting the attention of young children may not come handy. It is thus an object of the present invention to provide a window shade in which the aforesaid shortcomings are mitigated, or at least to provide a useful alternative to the public.

SUMMARY OF THE INVENTION

According to the present invention, there is provided a window shade including at least a sheet of shade material adapted to provide shade from light, a panel with electrically powered means for producing motion, light and/or sound, and means for detachably attaching said sheet of shade material to a window.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENTS

Figure 1:
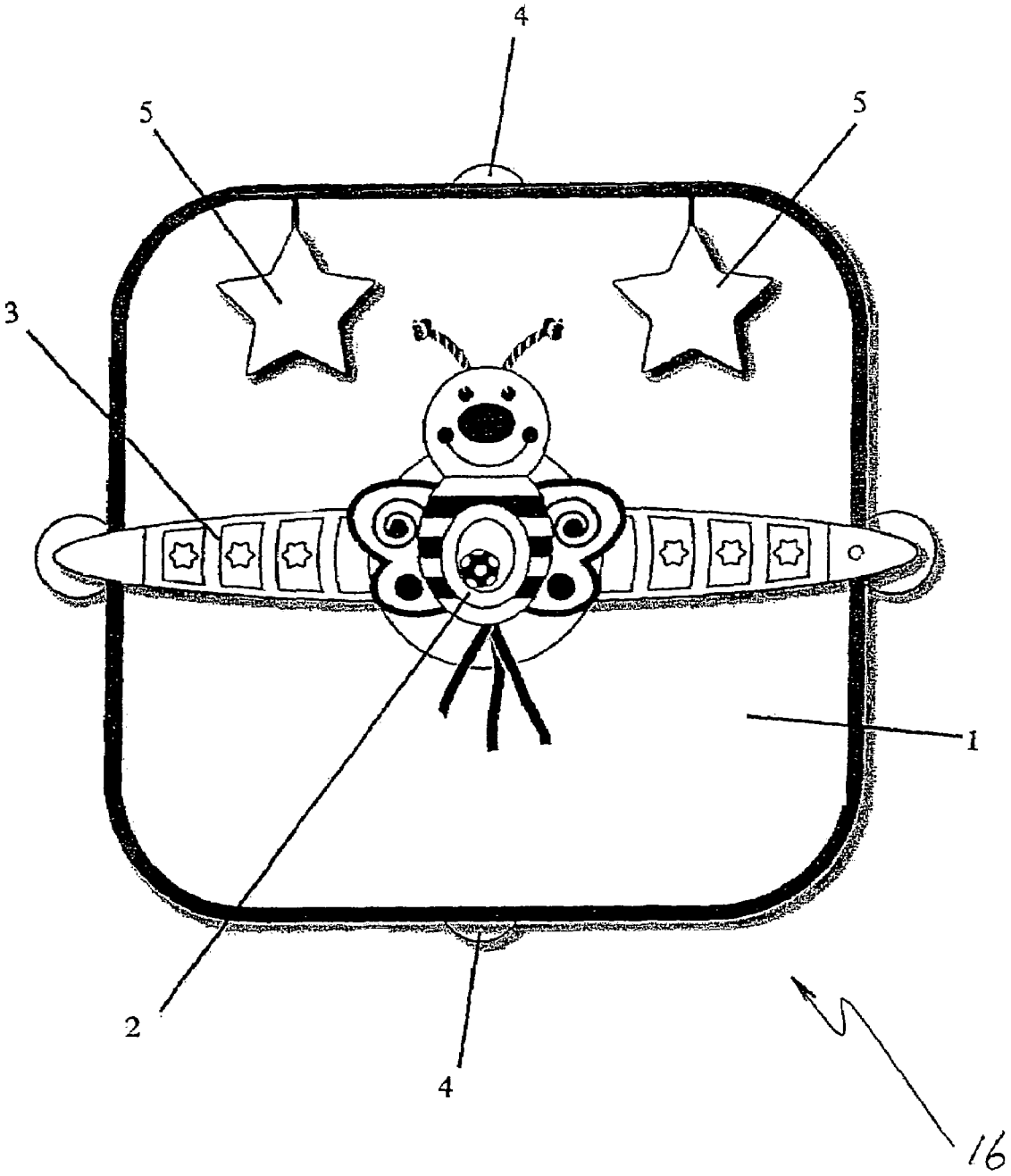
FIG. 1 is a front view of a window shade according to a preferred embodiment of the present invention.

A window shade according to a preferred embodiment of the present invention is shown in FIG. 1 and generally designated as 16. The window shade 16 includes a sheet of translucent shade material 1 for providing shade from light. Attached to the sheet of shade material 1 is an entertainment panel 3. Releasably attached to the entertainment panel 3 is a plush toy 2. The sheet of shade material 1 is fixedly engaged with a number of suction cups 4 for releasably attaching the sheet of shade material 1 (and thus the panel 3 attached with the sheet of shade material 1) to a window. A number of plush toys 5 are also attached to various other positions of the sheet of shade material 1 for enhancing the aesthetic appeal.

The sheet of shade material 1 may be fixedly secured with the panel 3, e.g. by rivets or other conventional means. The sheet of shade material 1 may also be releasably secured with the panel 3, e.g. by screws, so as to allow the sheet of shade material 1 to be removed from the panel 3, e.g. for cleaning.

Figure 2:
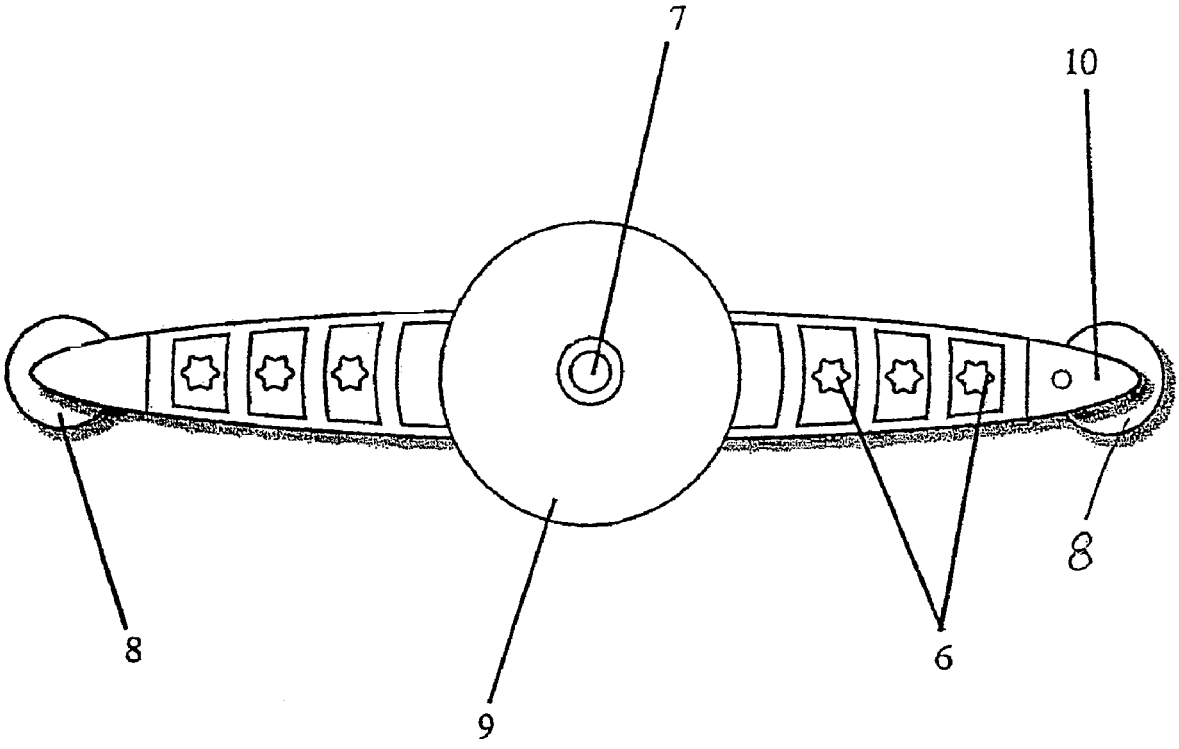
FIG. 2 is a front view of a panel of the window shade shown in FIG. 1.

As shown in more details in FIG. 2, six light-emitting diodes (LED's) 6 are disposed on the panel 3. A socket 7 with a plug (not shown) is disposed on a housing 9. The socket 7 is engaged with an output spindle (not shown) of a motor housed in the housing 9. One of a number of plush toys 2 is selectively engaged with the socket 7. When the motor in the housing 9 is activated, the output-spindle will rotate, thus bringing about rotational movement of the socket 7, and consequently the plush toy 2 engaged therewith.

At each end of the panel 3 is a suction cup 8 for releasably attaching the panel 3 to the window. Located at one end of the panel 3 is also an infrared sensor 10 for receiving infrared signals from an infrared transmitter (to be discussed below) for controlling the operation of the window shade 16.

Figure 3:
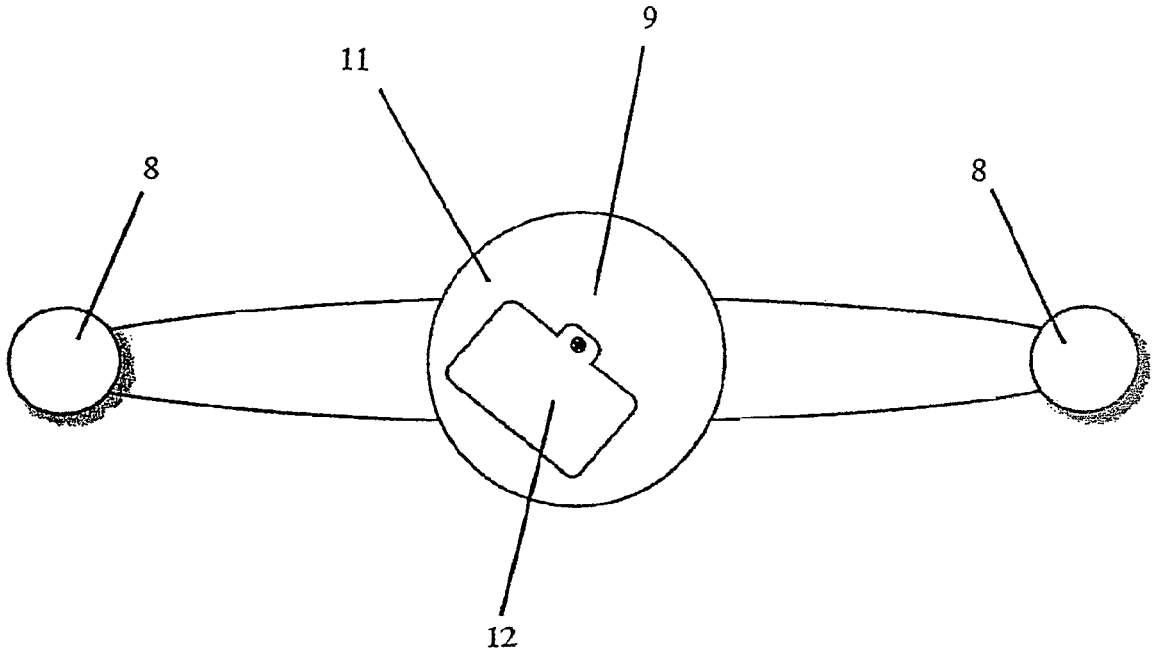
FIG. 3 is a back view of the panel shown in FIG. 2.

In the housing 9 is a speaker 11 for producing sound. As shown in FIG. 3, on an underside of the housing 9 is a removable lid 12 leading into a cavity for housing one or more electric batteries (not shown) for powering the motor, the speaker 11 and the LED's 6 of the panel 3 of the window shade 16.

Figure 4A:
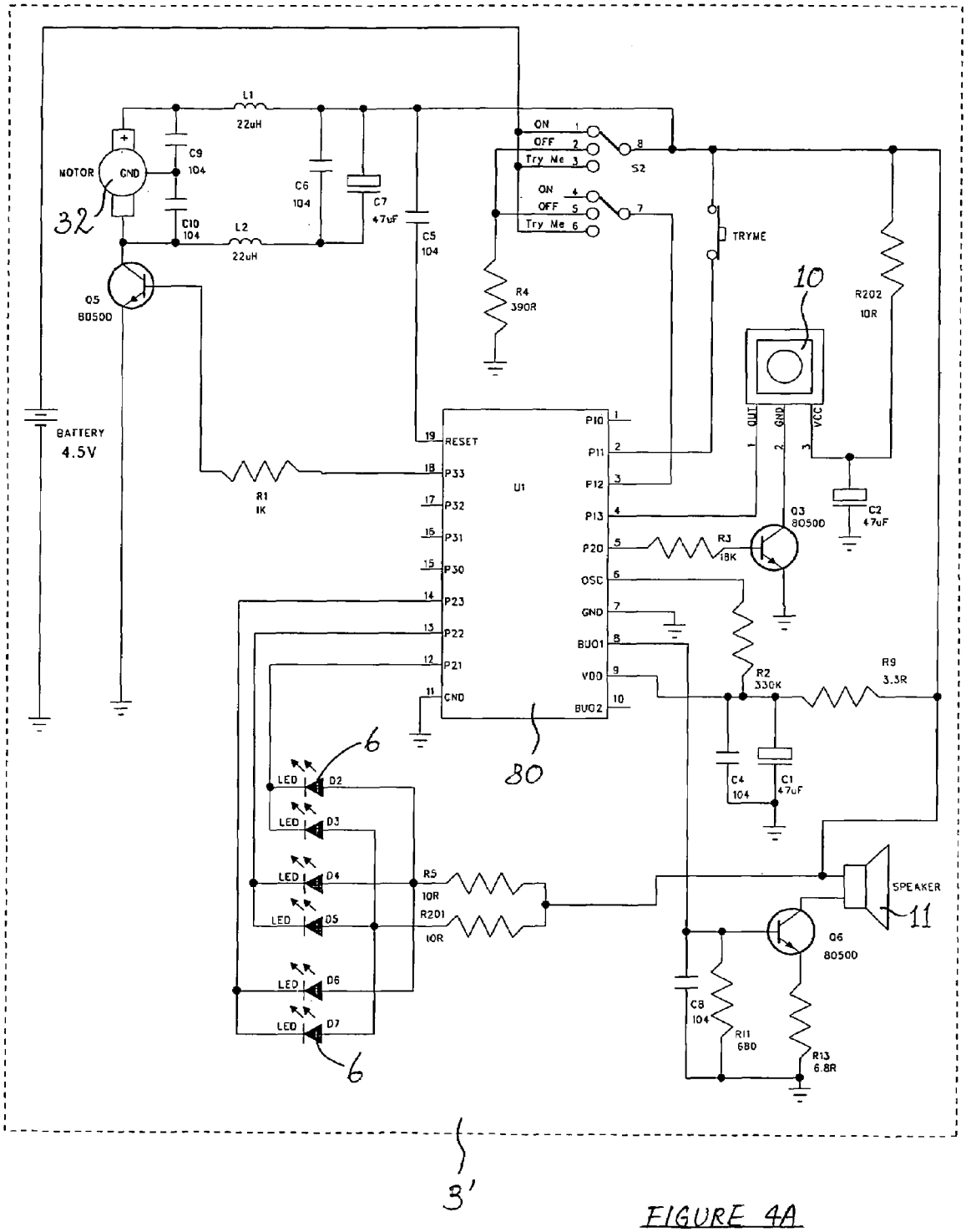
FIG. 4A is a circuit diagram of the panel shown in FIG. 2.

As shown in FIG. 4A, the panel 3 is incorporated with a circuit generally referred to as 3'. The circuit 3' includes an integrated circuit (IC) 30 for storing a number of songs for output through the speaker 11, and for generally controlling the operation of the window shade 16, including the motor and the LED's 6. An IC which may be used is a direct drive speech/melody controller traded by Sonix Technology Co., Ltd. of Taiwan under series No. SNC312. The SNC312 controller is a one-channel voice/melody synthesizer IC with pulse width modulation (PWM) direct drive circuit, with a built-in 4-bit tiny controller with one 4-bit input port and two 4-bit I/O ports. By programming through the tiny controller, user applications including voice section combination, key trigger, output control, and other logic functions can be implemented. It is also built in with an ASPCM hardware circuit to synthesize voice output.

It can be seen that the IC 30 is connected with and controls the operation of the motor 32 for rotating the socket 7, and thus the plush toy 2 engaged therewith, the LED's 6 and the speaker 11. The IC 30 is also connected with an infrared sensor 10 for receiving infrared signals from the infrared transmitter for controlling the operation of the panel 3 of the window shade 16.

Figure 4B:
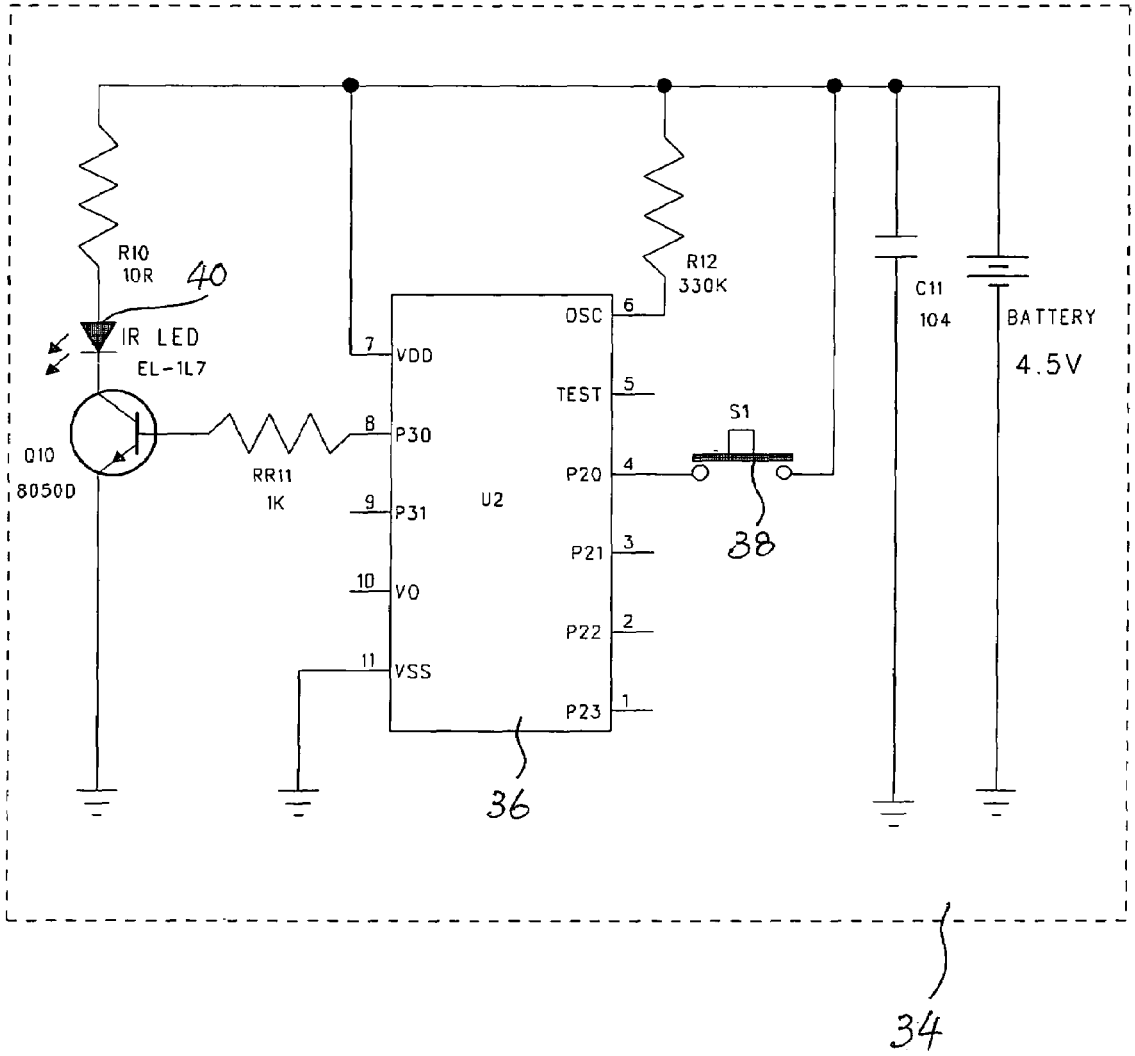
FIG. 4B is a circuit diagram of an infrared transmitter used in the present invention.

The infrared transmitter is incorporated with a circuit generally referred to as 34 as shown in FIG. 4B. The circuit 34 includes an integrated circuit (IC) 36 which, when activated by a switch 38, causes an infrared LED 40 to emit infrared radiation, to be received by the infrared sensor 10 in the circuit 3'. An appropriate IC for the circuit 34 may be a speech controller traded by Sonix Technology Co., Ltd. of Taiwan under series No. SN67004. This is a 4 seconds single chip voice synthesizer IC which contains I/O pins and a tiny controller. By programming through the tiny controller, user applications including section combination, trigger modes, output status, and other logic functions can be implemented.

To operate the window shade 16, an ON/OFF switch (not shown) on the panel 3 is moved to the ON position, thus activating the infrared sensor 10, ready for receiving infrared signals from the infrared transmitter. When infrared signals are received, corresponding signals are transmitted to the IC 30, which in turn activates the motor 32, thus bringing about rotational movement of the output spindle of the motor 32. The plush toy 2 engaged with the motor 32 is consequently brought into rotational movement, or other pre-determined manner of movement.

Upon receipt of signals from the infrared sensor 10, the IC 30 also transmits signals to cause the speaker 11 to play music or songs stored in the IC 30 in a pre-determined sequence or one of a number of pre-determined sequences. The LED's 6 are also caused to emit light in a pre-determined sequence or one of a number of pre-determined sequences.

When a further signal is received by the infrared sensor 10 from the infrared transmitter, the motor 32 will be deactivated, thus stopping rotational movement of the plush toy 2. The LED's 6 will stop emitting light and the speaker 11 will also stop playing the music or songs.

It should be understood that the above only illustrates an example whereby the present invention may be carried out, and that various modifications and/or alterations may be made thereto without departing from the spirit of the invention.

It should also be understood that certain features of the invention, which are, for clarity, described here in the context of separate embodiments, may be provided in combination in a single embodiment.

What is claimed is:

1. A window shade comprising at least a sheet of shade material adapted to provide shade from light, a panel attached directly to the sheet and having electrically powered means for producing motion, and light and/or sound, and means for detachably attaching said sheet of shade material to a window, wherein said means for producing motion, and light and/or sound includes a decorative article visible to a user, said decorative article being movable by said means for producing motion, and light and/or sound to rotate relative to said sheet of shade material.

2. A window shade according to claim 1 wherein said motion, light and/or sound is produced in at least one pre-determined manner.

3. A window shade according to claim 1 wherein said panel is fixedly secured with said sheet of shade material.

4. A window shade according to claim 1 wherein said panel is releasably secured with said sheet of shade material.

5. A window shade according to claim 1 wherein said sheet of shade material is translucent.

6. A window shade according to claim 1 wherein said panel includes means for detachably attaching said panel to said window.

7. A window shade according to claim 6 wherein said means for detachably attaching said panel to said window includes at least a suction cup.

8. A window shade according to claim 1 wherein said means for detachably attaching said sheet of shade material to said window includes at least a suction cup.

9. A window shade according to claim 1 wherein said decorative article is rotatable relative to said sheet of shade material about an axis that is perpendicular to a plane defined by said sheet of shade material.

10. A window shade according to claim 1 wherein said motion-producing means is releasably attachable with said decorative article.

11. A window shade according to claim 1 further including an infrared sensor adapted to receive infrared signals from an infrared transmitter.

12. A window shade according to claim 1 wherein said light-producing means includes at least one light-emitting diode (LED) adapted to emit light in a pre-determined sequence.

13. A window shade according to claim 1 wherein said sound-producing means includes an integrated circuit for storing music.

14. A window shade according to claim 13 further including a speaker adapted to output the music stored in said integrated circuit.

* * * * *